US010436532B2

(12) United States Patent
Walton

(10) Patent No.: US 10,436,532 B2
(45) Date of Patent: Oct. 8, 2019

(54) FIREARM RELOADING SYSTEM AND METHOD

(71) Applicant: Joshua Walton, Perrysburg, OH (US)

(72) Inventor: Joshua Walton, Perrysburg, OH (US)

(73) Assignee: Joshua Walton, Perrysburg, OH (US)

( * ) Notice: Subject to any disclaimer, the term of this patent is extended or adjusted under 35 U.S.C. 154(b) by 0 days.

(21) Appl. No.: 15/896,798

(22) Filed: Feb. 14, 2018

(65) Prior Publication Data

US 2018/0231339 A1 Aug. 16, 2018

Related U.S. Application Data

(60) Provisional application No. 62/459,448, filed on Feb. 15, 2017.

(51) Int. Cl.
*F41A 9/67* (2006.01)
*F41A 9/83* (2006.01)
*F41A 9/84* (2006.01)

(52) U.S. Cl.
CPC ..... *F41A 9/67* (2013.01); *F41A 9/83* (2013.01); *F41A 9/84* (2013.01)

(58) Field of Classification Search
CPC ..... F41A 9/66; F41A 9/67; F41A 9/71; F41A 9/83; F41A 9/84
USPC ..... 42/50
See application file for complete search history.

(56) References Cited

U.S. PATENT DOCUMENTS 1,245,499 A * 11/1917 Orme ..... F41A 9/67 124/52
4,614,052 A * 9/1986 Brown ..... F41A 9/83 42/50
5,309,660 A * 5/1994 Blackamore ..... F42B 33/14 42/106
5,666,752 A * 9/1997 Grams ..... F41A 9/71 42/49.02
9,057,570 B1 6/2015 Tal
2014/0373416 A1* 12/2014 Barnhart ..... F41A 9/67 42/50

FOREIGN PATENT DOCUMENTS

DE 102005028603 A1 * 12/2006 ..... F41A 9/65

* cited by examiner

*Primary Examiner* — Stephen Johnson

(57) ABSTRACT

A firearm magazine assembly includes a magazine-body, a movable-member, a spring, a securement-member, and a key-member. The spring includes a spring-length configured for repeated selective compression and extension, as needed. The firearm magazine assembly is useful for providing a firearm magazine configured for quick loading and reloading of a firearm.

19 Claims, 5 Drawing Sheets

FIREARM RELOADING SYSTEM AND METHOD

CROSS REFERENCE TO RELATED APPLICATION

The present application is related to and claims priority to U.S. Provisional Patent Application No. 62/459,448 filed Feb. 15, 2017, which is incorporated by reference herein in its entirety.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

1. Field of the Invention

The present invention relates generally to the field of firearms and more specifically relates to a quick reload magazine for a firearm.

2. Description of Related Art

Small firearms, including pistols, assault rifles, and submachine guns, utilize and fire rounds (also known as cartridges and ammunition). A magazine is an ammunition storage and feeding device within or attached to a repeating firearm. Magazines can be removable (detachable) or integral (internal/fixed) to the firearm. The magazine functions by moving the cartridges stored within it into a position where they may be loaded into the barrel chamber by the action of the firearm. Prior to use, a firearm magazine must be loaded (charged or filled).

When a magazine is being loaded, it is necessary to depress all previously loaded rounds to provide space below the lips, so an additional round can be inserted. Each time another round is loaded the spring is further compressed, requiring more insertion force. When a magazine is fully loaded, the spring is fully compressed and exerts maximum upward force against the follower and rounds towards the lips. Loading magazines is relatively time-consuming, tedious, and painful if done with bare fingers. Pain accumulates and intensifies as more rounds are loaded against the increasing spring pressure, thereby slowing the loading process. When a plurality of magazines is to be loaded, much time is required, shortening reposing, training, or combat time. In combat circumstances, slow reloading can be life-threatening. Thus, a suitable solution is desired.

U.S. Pat No. 9,057,570 to Guy Tal relates to a loader for magazines with projecting side button. The described loader for magazines with projecting side button includes a projecting side button coupled to a follower. Two similar and substantially flat flaps are hinged by a pin along their longer side. A torsion spring encompasses the pin and is positioned between the flaps, forcing them apart. Each flap has a substantially rectangular opening sized and positioned to fit over a magazine. The flaps can angle between an open position and a closed (parallel and touching) position. To load the magazine, a user squeezes and holds the flaps ends closed to align the openings so that the openings can be slid over the magazine to push the button down. Upon releasing the flaps they open, locking the openings on the magazine. Rounds then can easily be loaded into the magazine. The loader may use a grasping member in lieu of flaps.

BRIEF SUMMARY OF THE INVENTION

In view of the foregoing disadvantages inherent in the known firearms art, the present disclosure provides a novel firearm reloading system and method. The general purpose of the present disclosure, which will be described subsequently in greater detail, is to provide an improved firearm magazine for quick reloading of the same.

A firearm magazine assembly is disclosed herein. The firearm magazine assembly includes a magazine-body which may include a first magazine-end, a second magazine-end opposite the first magazine-end, an inner-capacity defined by an outer-shell and an insertion-slot. One of the first magazine-end or the second magazine-end may have a loading-end configured to receive at least one bullet, and the inner-capacity may be configured to removably house the at least one bullet. Further, a movable-member may be located within the inner-capacity and include a bullet-receiving surface, a spring-receiving surface, and a key-receiving aperture. The bullet-receiving surface may be configured to sit beneath the at least one bullet. A spring may be attached to the spring-receiving surface at a first spring-end and housed within the inner-capacity of the magazine-body.

Further, the spring may include a second spring-end opposite the first spring-end and a spring-length therebetween; the spring-length being configured for repeated selective compression and extension, as needed. In addition, a securement-member may be provided and configured for securement over another one of the first magazine-end or the second magazine-end. In addition to this, a key-member may be provided and configured for selective insertion into the insertion-slot and the key-receiving aperture. The selective insertion of the key-member into the insertion-slot and the key receiving aperture may allow for the selective compression and extension of the spring-length via the movable-member.

A method of using firearm magazine assembly is also disclosed herein. The method of using firearm magazine assembly may comprise the steps of: providing the firearm magazine assembly as above; inserting the key-member into the insertion-slot and the key-receiving aperture; compressing the spring-length via the movable-member; loading at least one bullet into the inner-capacity; removing the key-member from the insertions-lot and the key-receiving aperture; and loading the magazine-body into a firearm.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a firearm reloading system and method, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to firearms and more particularly to a firearm reloading system and method as used to provide quick reload magazines for a firearm.

Generally, disclosed is a firearm magazine assembly designed to solve the problem of gun magazines being particularly difficult to reload. This assembly may be designed solely for use with a '1911 style' firearm chambered for a .45ACP® cartridge; however, the concept may be adopted in to virtually any style handgun magazine. The assembly may require the use of no external equipment to help reload bullets into the magazine.

The magazine may include a 'Mag Tube', a 'Bullet Follower', a Spring, a 'Pommel' and a Key. The Mag Tube may be the centre component of the magazine's construction. Horizontal filleted grooves cut into the bottom of the Mag Tube may be used to help secure the Pommel. Before the Pommel is fixed securely in place, two components may be installed through the bottom of the Mag Tube; the Bullet Follower and the Spring. With the Bullet Follower sliding in first, and the Spring pressed in compression behind it, the Pommel may then be secured into place. The mag Tube may also be referred to as a magazine body. The Pommel may also be referred to as a baseplate or a securement-member. The Bullet Follower may also be referred to as a movable-member or a cartridge-follower.

The Pommel may use two flexible tabs that secure to a bottom horizontal grooves cut into the Mag Tube. With the main components in place, the last component may be installed. The last component, the Key, may slide into the bottom of the Pommel where two additional tabs provide an interference fit.

The magazine may be held securely by either using a flat surface to support the bottom Pommel or by using the user's hand. The Key may then be temporarily removed from the Pommel to be used to help load the bullets. The Key may accomplish this by being inserted through the vertical slot cut into the Mag Tube body and into the Bullet Follower. The user may then use his/her thumb or other finger to gently glide the Bullet Follower down as each bullet is inserted through the top of the Mag Tube. After the magazine has been loaded, the Key may then be either set aside or returned to the Pommel during its use.

Referring now more specifically to the drawings by numerals of reference, there is shown in FIGS. 1-5, various views of a firearm magazine assembly 100.

Figure 1:
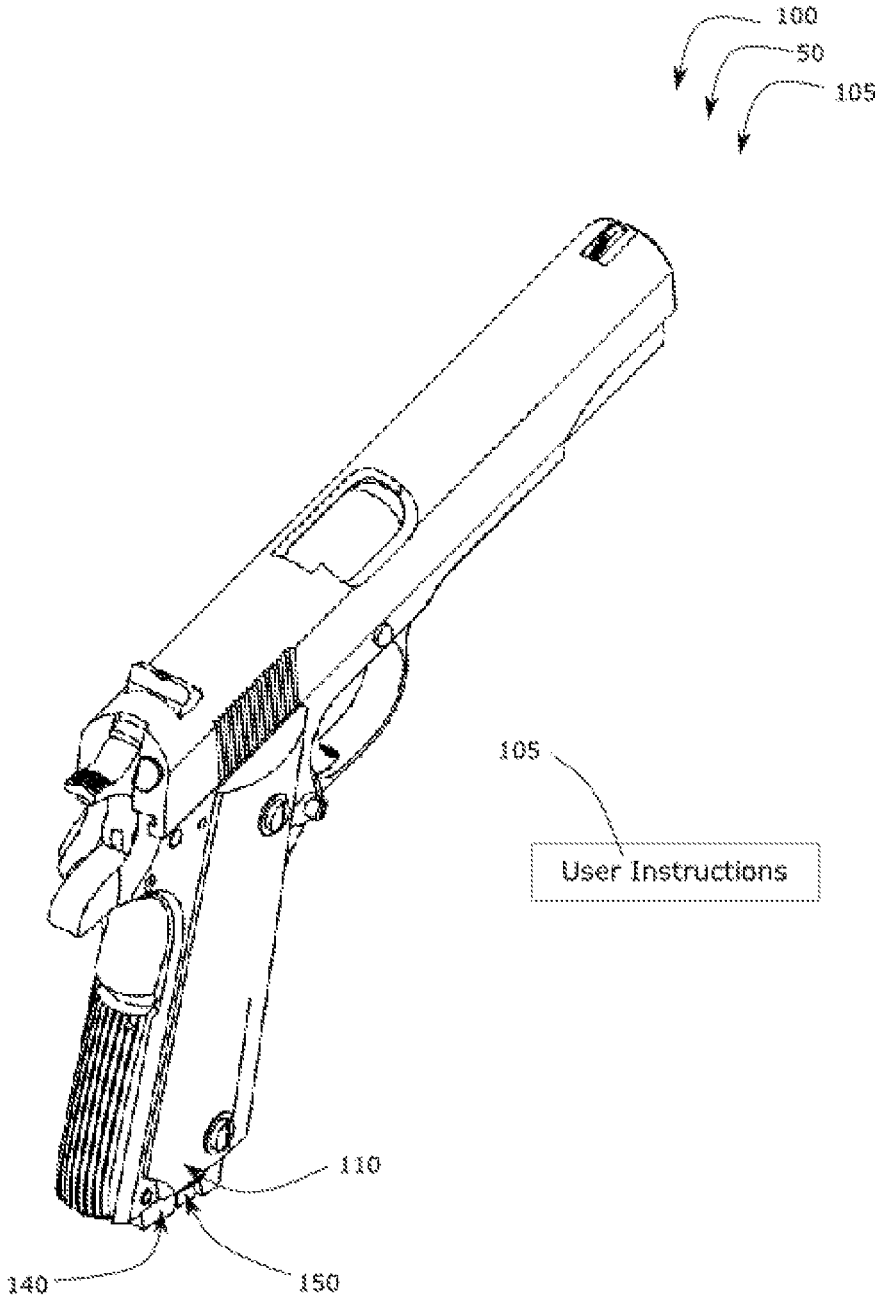
FIG. 1 is a side perspective view of the firearm magazine assembly during an 'in-use' condition, according to an embodiment of the disclosure.

FIG. 1 shows a firearm magazine assembly 100 during an 'in-use' condition 50, according to an embodiment of the present disclosure. Here, the 'in-use' condition 50 is the firearm magazine assembly 100 within a firearm. As illustrated, the firearm magazine assembly 100 may include a magazine-body 110, a movable-member 120 (FIG. 2), a spring 130 (FIG. 2), a securement-member 140, and a key-member 150.

According to one embodiment, the firearm magazine assembly 100 may be arranged as a kit 105. The kit 105 may include set of instructions 107. The instructions 107 may detail functional relationships in relation to the structure of the firearm magazine assembly 100 (such that the firearm magazine assembly 100 can be used, maintained, or the like, in a preferred manner).

Figure 2:
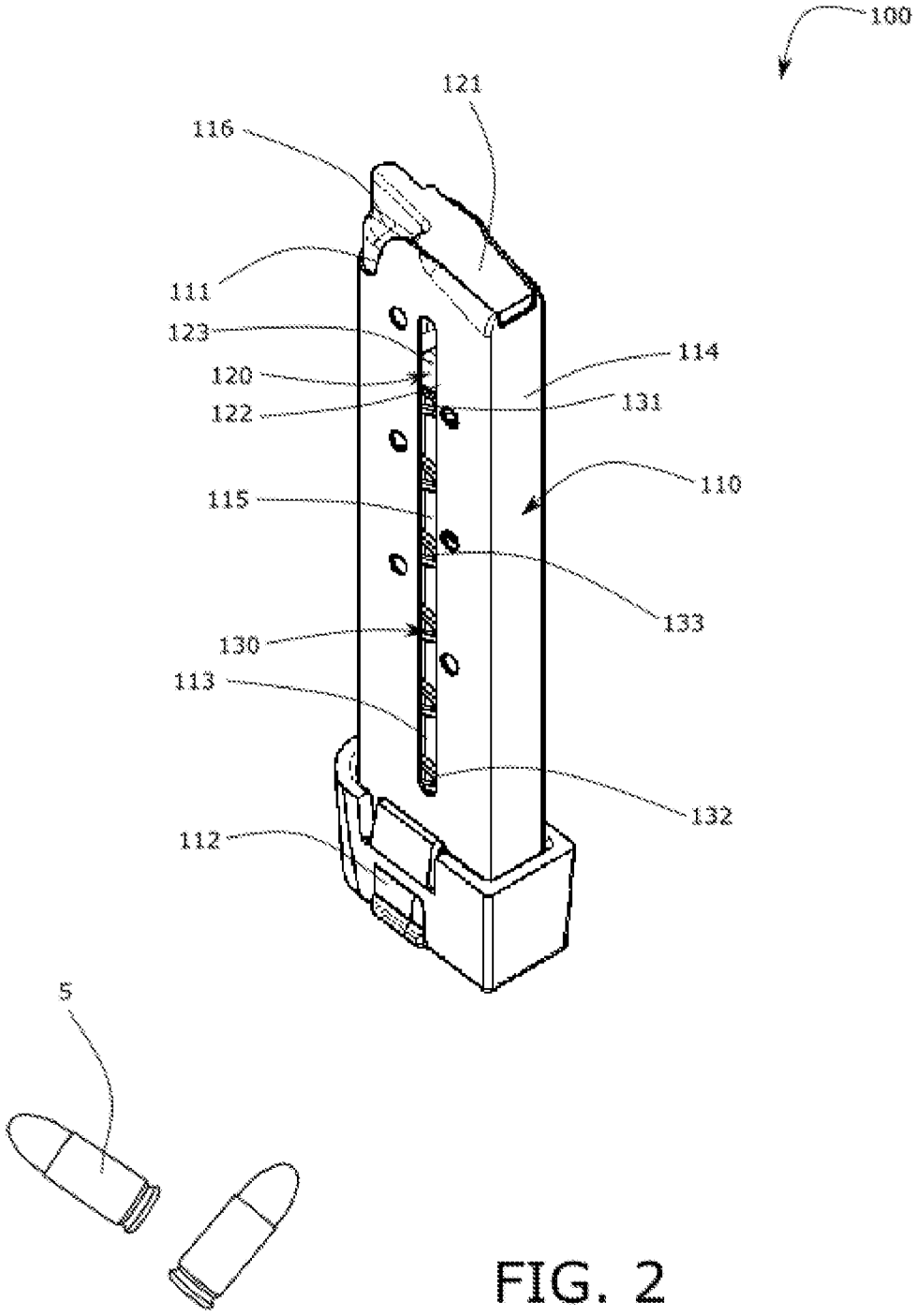
FIG. 2 is a front perspective view of the firearm magazine assembly of FIG. 1, according to an embodiment of the present disclosure.

Referring now to FIG. 2 showing a front perspective view of the firearm magazine assembly 100 of FIG. 1, according to an embodiment of the present disclosure. The magazine-body 110 may include a first magazine-end 111, a second magazine-end 112 opposite the first magazine-end 111, an inner-capacity 113 defined by an outer-shell 114 and an insertion-slot 115. One of the first magazine-end 111 and the second magazine-end 112 may have a loading-end 116 configured to receive at least one bullet 5, and the inner-capacity 113 may be configured to removably house the at least one bullet 5. In a preferred embodiment, the at least one bullet 5 may be 11.43×23 mm. Further, the inner-capacity 113 may be configured to house at least eight bullets 5.

As illustrated, the movable-member 120 may be located within the inner-capacity 113. The movable-member 120 may include a bullet-receiving surface 121, a spring-receiving surface 122, and a key-receiving aperture 123. The bullet-receiving surface 121 may be configured to sit beneath the at least one bullet 5.

The spring 130 may be attached to the spring-receiving surface 122 of the movable-member 120 at a first spring-end 131 and housed within the inner-capacity 113 of the magazine-body 110. Further, the spring 130 may include a second spring-end 132 opposite the first spring-end 131 and a spring-length 133 therebetween. The spring-length 133 may be configured for repeated selective compression and extension, as needed. As bullets 5 are fired from the firearm, the spring-length 133 may extend, pushing the bullets 5 up into a feeding-position via the movable-member 120. The repeated selective compression and extension may via manual actuation by the user.

Figure 3:
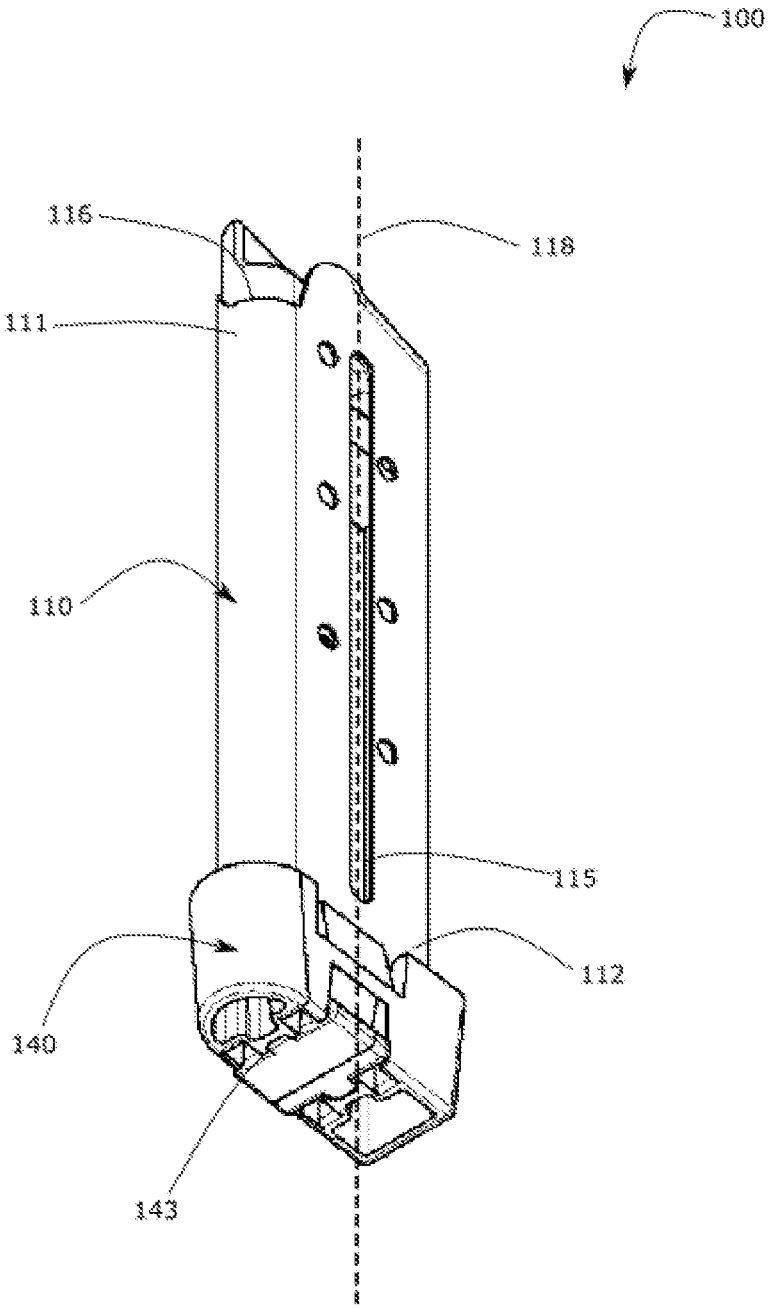
FIG. 3 is a side-bottom perspective view of the firearm magazine assembly of FIG. 1, according to an embodiment of the present disclosure.

FIG. 3 shows a side-bottom perspective view of the firearm magazine assembly 100 of FIG. 1, according to an embodiment of the present disclosure. As shown, the securement-member 140 may be configured for securement over another one of the first magazine-end 111 and the second magazine-end 112. Further, the securement-member 140 may include securement-means 143 configured for attachment to the magazine-body 110.

As shown, the firearm-magazine may further include a vertical-axis 118 whereby the one of the first magazine-end 111 and the second magazine-end 112 may be located at a top-end of the firearm-magazine, and the another one of the first-end and the second-end opposite the loading-end 116 may be located at a bottom-end of the firearm-magazine. In addition to this, in the preferred embodiment, the insertion-slot 115 may be a vertical-aperture relative to the vertical-axis 118.

Figure 4:
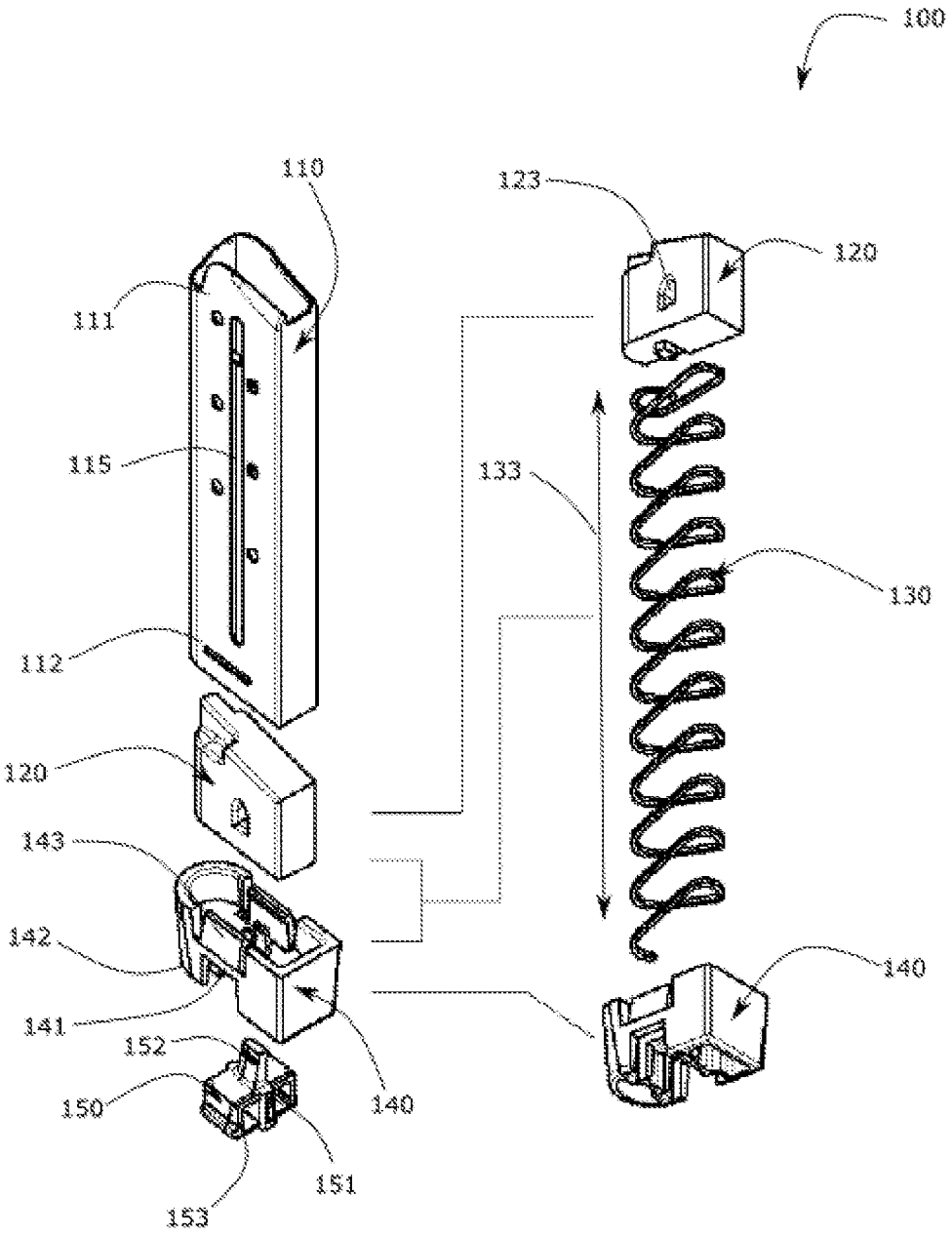
FIG. 4 is a front perspective view of the firearm magazine assembly of FIG. 1, according to an embodiment of the present disclosure.

Referring now to FIG. 4 showing a front perspective view of the firearm magazine assembly 100 of FIG. 1, according to an embodiment of the present disclosure. As above, the securement-member 140 may be configured for securement over another one of the first magazine-end 111 and the second magazine-end 112 via the securement-means 143. Further, as illustrated, the securement-member 140 may include a key-housing 141 and the key-member 150 may be configured to be housed within the key-housing 141 when not in use. As shown, the key-housing 141 may be located in a bottom-surface 142 of the securement-member 140. In other embodiments, the key-housing 141 may be located on a side-surface of the securement-member 140. The second magazine-end 112 may include securement-apertures 119 therein. In addition, the securement-member 140 may include securement-means 143 configured for attachment to the securement-apertures 119. In the preferred embodiment, the securement-means 143 may be two flexible tabs. However, other securement-means 143 may be used.

The key-member 150 may be configured for selective insertion into the insertion-slot 115 and the key-receiving aperture 123, and the selective insertion of the key-member 150 into the insertion-slot 115 and the key receiving aperture 123 may allow for the selective compression and extension of the spring-length 133 via the movable-member 120. As shown, the key-member 150 may include a key-body 151 and a key-end 152. The key-body 151 may include a gripping-surface 153 configured to provide positive-grip for a user on the key-member 150, and the key-end 152 may be sized for insertion into the key-receiving aperture 123. To facilitate this, the key-end 152 and the key-receiving aperture 123 may include a same shape. Further, in the preferred embodiment, key-body 151 may sit flush with the bottom-surface 142 of the securement-member 140 when the key-end 152 is housed within the key-housing 141.

Figure 5:
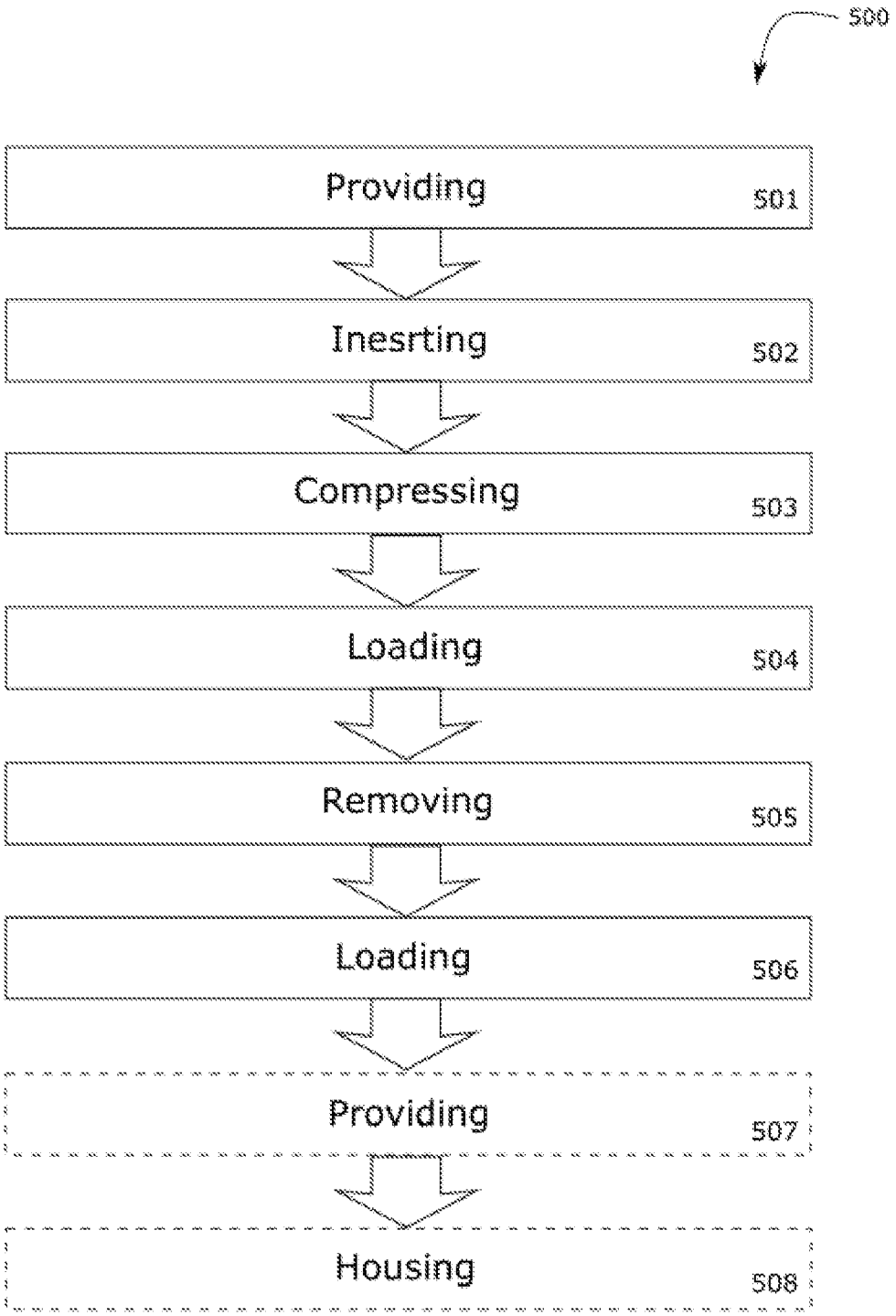
FIG. 5 is a flow diagram illustrating a method of use for the firearm magazine assembly, according to an embodiment of the present disclosure.

FIG. 5 is a flow diagram illustrating a method of using a firearm magazine assembly 500, according to an embodiment of the present disclosure. As illustrated, the method of using a firearm magazine assembly 500 may include the steps of: step one 501, providing the firearm magazine assembly 100 as above; step two 502, inserting the key-member 150 into the insertion-slot 115 and the key-receiving aperture 123; step three 503, compressing the spring-length 133 via the movable-member 120; step four 504, loading at least one bullet 5 into the inner-capacity 113; step five 505, removing the key-member 150 from the insertion-slot 115 and the key-receiving aperture 123; and step six 506, loading the magazine-body 110 into a firearm. Further steps may include: step seven 507, providing the firearm magazine assembly 100 further including a key-housing 141 located within the securement-member 140; and step eight 508, housing the key-member 150 within the key-housing 141 when not in use.

It should be noted that step seven 507 and step eight 508 are optional steps and may not be implemented in all cases. Optional steps of method of use 500 are illustrated using dotted lines in FIG. 5 so as to distinguish them from the other steps of method of use 500. It should also be noted that the steps described in the method of use can be carried out in many different orders according to user preference. The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods for firearm magazine assembly 100 (e.g., different step orders within above-mentioned list, elimination or addition of certain steps, including or excluding certain maintenance steps, etc.), are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A firearm magazine assembly comprising:

a magazine-body including a first magazine-end, a second magazine-end opposite the first magazine-end, an inner-capacity defined by an outer-shell and an insertion-slot, the first magazine-end having a loading-end configured to receive at least one bullet, and wherein the inner-capacity is configured to removably house the at least one bullet;

a movable-member located within the inner-capacity, the movable-member including a bullet-receiving surface, a spring-receiving surface, and a key-receiving aperture, and wherein the bullet-receiving surface is configured to sit beneath the at least one bullet;

a spring attached to the spring-receiving surface at a first spring-end and housed within the inner-capacity of the magazine-body, the spring further including a second spring-end opposite the first spring-end and a spring-length therebetween, the spring-length being configured for repeated selective compression and extension, as needed;

a securement-member configured for securement over the second magazine-end; and a key-member configured for selective insertion into the insertion-slot and the key-receiving aperture, and wherein the selective insertion of the key-member into the insertion-slot and the key receiving aperture allows for the selective compression and extension of the spring-length by pressing on the key-member in tandem with the movable-member with a thumb of a user, such that the spring is able to be compressed beneath the movable-member.

2. The firearm magazine assembly of claim 1, wherein the securement-member includes a key-housing.

3. The firearm magazine assembly of claim 2, wherein the key-member is configured to be housed within the key-housing when not in use.

4. The firearm magazine assembly of claim 3, wherein the key-housing is located in a bottom-surface of the securement-member.

5. The firearm magazine assembly of claim 3, wherein the key-housing is located on a side-surface of the securement-member.

6. The firearm magazine assembly of claim 1, wherein the key-member includes a key-body and a key-end.

7. The firearm magazine assembly of claim 6, wherein the key-body includes a gripping-surface configured to provide positive-grip for a user on the key-member.

8. The firearm magazine assembly of claim 7, wherein the key-end is sized for insertion into the key-receiving aperture.

9. The firearm magazine assembly of claim 8, wherein the key-body sits flush with the bottom-surface of the securement-member when the key-end is housed within the key-housing.

10. The firearm magazine assembly of claim 1, wherein the another one of the first-end and the second-end includes securement-apertures therein.

11. The firearm magazine assembly of claim 10, wherein the securement-member includes securement-tabs configured for attachment to the securement-apertures, the securement-tabs comprising two flexible tabs dimensioned to engage the securement-apertures.

12. The firearm magazine assembly of claim 1, wherein the at least one bullet is 11.43×23 mm.

13. The firearm magazine assembly of claim 12, wherein the inner-capacity is configured to house at least eight bullets.

14. The firearm magazine assembly of claim 1, wherein the firearm-magazine further includes a vertical-axis whereby the one of the first-end and the second-end including the loading-end is located at a top-end of the firearm-magazine; and wherein the another one of the first-end and the second-end opposite the loading-end is located at a bottom-end of the firearm-magazine.

15. The firearm magazine assembly of claim 1, wherein the insertion-slot is a vertical-aperture relative to the vertical-axis.

16. A firearm magazine assembly comprising:

a magazine-body including a first magazine-end, a second magazine-end opposite the first magazine-end, an inner-capacity defined by an outer-shell and an insertion-slot, the first magazine-end having a loading-end configured to receive at least one bullet, and wherein the inner-capacity is configured to removably house the at least one bullet;

a movable-member located within the inner-capacity, the movable-member including a bullet-receiving surface, a spring-receiving surface, and a key-receiving aperture, and wherein the bullet-receiving surface is configured to sit beneath the at least one bullet;

a spring attached to the spring-receiving surface at a first spring-end and housed within the inner-capacity of the magazine-body, the spring further including a second spring-end opposite the first spring-end and a spring-length therebetween, the spring-length being configured for repeated selective compression and extension, as needed;

a securement-member configured for securement over the second magazine-end; and a key-member configured for selective insertion into the insertion-slot and the key-receiving aperture, and wherein the selective insertion of the key-member into the insertion-slot and the key receiving aperture allows for the selective compression and extension of the spring-length by pressing on the key-member in tandem with the movable-member with a thumb of a user, such that the spring is able to be compressed beneath the movable-member;

wherein the securement-member includes a key-housing;

wherein the key-member is configured to be housed within the key-housing when not in use;

wherein the key-housing is located in a bottom-surface of the securement-member;

wherein the key-housing is located on a side-surface of the securement-member;

wherein the key-member includes a key-body and a key-end;

wherein the key-body includes a gripping-surface configured to provide positive-grip for a user on the key-member;

wherein the key-end is insertable into the key-receiving aperture, the key-end being dimensioned no larger than the key-receiving aperture, the key-end being substantially conformed to a shape of the key-receiving aperture;

wherein the key-body sits flush with the bottom-surface of the securement-member when the key-end is housed within the key-housing;

wherein the second magazine-end includes securement-apertures therein;

wherein the securement-member includes securement-tabs configured for attachment to the securement-apertures;

the securement-tabs comprising two flexible tabs;

wherein the at least one bullet is 11.43×23 mm;

wherein the inner-capacity is configured to house at least eight bullets;

wherein the firearm-magazine further includes a vertical-axis whereby the one of the first-end and the second-end including the loading-end is located at a top-end of the firearm-magazine;

wherein the another one of the first-end and the second-end opposite the loading-end is located at a bottom-end of the firearm-magazine; and wherein the insertion-slot is a vertical-aperture relative to the vertical-axis.

17. The firearm magazine assembly of claim 16, further comprising set of instructions; and wherein the firearm magazine assembly is arranged as a kit.

18. A method of using a firearm magazine assembly, the method comprising the steps of:

providing the firearm magazine assembly, the firearm magazine assembly including:

a magazine-body including a first magazine-end, a second magazine-end opposite the first magazine-end, an inner-capacity defined by an outer-shell and an insertion-slot, the first magazine-end having a loading-end configured to receive at least one bullet, and wherein the inner-capacity is configured to removably house the at least one bullet;

a movable-member located within the inner-capacity, the movable-member including a bullet-receiving surface, a spring-receiving surface, and a key-receiving aperture, and wherein the bullet-receiving surface is configured to sit beneath the at least one bullet;

a spring attached to the spring-receiving surface at a first spring-end and housed within the inner-capacity of the magazine-body, the spring further including a second spring-end opposite the first spring-end and a spring-length therebetween, the spring-length being configured for repeated selective compression and extension, as needed;

a securement-member configured for securement over the second magazine-end; and a key-member configured for selective insertion into the insertion-slot and the key-receiving aperture, and wherein the selective insertion of the key-member into the insertion-slot and the key receiving aperture allows for the selective compression and extension of the spring-length by pressing on the key-member in tandem with the movable-member with a thumb of a user, such that the spring is able to be compressed beneath the movable-member;

inserting the key-member into the insertion-slot and the key-receiving aperture;

compressing the spring-length via the movable-member;

loading at least one bullet into the inner-capacity;

removing the key-member from the insertion-slot and the key-receiving aperture; and loading the magazine-body into a firearm.

19. The method of claim 18, further comprising the steps of:

providing the firearm magazine assembly further including a key-housing located within the securement-member; and housing the key-member within the key-housing when not in use.

* * * * *